US006786763B2

(12) United States Patent
Wu

(10) Patent No.: US 6,786,763 B2
(45) Date of Patent: Sep. 7, 2004

(54) CABLE END CONNECTOR ASSEMBLY HAVING RELATIVELY SIMPLE STRUCTURE AND IMPROVED TERMINAL STRUCTURE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/353,327

(22) Filed: Jan. 28, 2003

(65) Prior Publication Data

US 2004/0157490 A1 Aug. 12, 2004

(51) Int. Cl.[7] ..... H01R 12/24
(52) U.S. Cl. ..... 439/497; 439/608
(58) Field of Search ..... 439/497, 607, 439/610, 494, 499, 608

(56) References Cited

U.S. PATENT DOCUMENTS 5,190,473 A * 3/1993 Mroczkowski et al. ..... 439/580
5,597,326 A * 1/1997 DeLessert et al. ..... 439/608
5,823,825 A * 10/1998 Murphy ..... 439/610
6,135,818 A * 10/2000 Lang et al. ..... 439/610
6,419,502 B1 7/2002 Trammel ..... 439/79
6,619,987 B2 * 9/2003 Kumamoto et al. ..... 439/610

* cited by examiner

*Primary Examiner*—Tulsidas C. Patel
(74) *Attorney, Agent, or Firm*—Wei Te Chung

(57) ABSTRACT

A cable end connector assembly (100) includes a base (2), a cover (3) fixed on the base, and a cable connector module (1) mounted between the cover and the base. The cable connector module comprises a cable (4), a plurality of shielding plates (8), and a plurality of signal terminals (7, 9). The cable comprises a plurality of lines (40) each comprising a first signal conductor (402) and a second signal conductor (404) located at an upper position and a lower position, respectively, and a grounding conductor (406). The shielding plates are respectively soldered with the grounding conductors. Each signal terminal comprises a mating portion (72, 92), and a tail portion (74, 94) being soldered with corresponding signal conductor. The tail portion comprises a plurality grasping portions (740, 940) extending vertically therefrom and grasping the signal conductor tightly for transmitting signals reliably.

19 Claims, 14 Drawing Sheets

CABLE END CONNECTOR ASSEMBLY HAVING RELATIVELY SIMPLE STRUCTURE AND IMPROVED TERMINAL STRUCTURE

CROSS-REFERENCE TO RELATED APPLICATION

This patent application is a co-pending application of U.S. patent application Ser. No. 10/264,650, filed on Oct. 10, 2002_, invented by Jerry Wu, Yin-Tse Kao, An-jen Yang, Yuan-Chieh Lin and Jim Zhao, entitled "CABLE CONNECTOR HAVING IMPROVED CROSS-TALK SUPPRESSING FEATURE" and assigned to the same assignee as this patent application. This patent application is a co-pending application of U.S. patent application Ser. No. 10/317,876, filed on Dec. 11, 2002, invented by Jerry Wu, entitled "CABLE CONNECTOR HAVING IMPROVED CROSS-TALK SUPPRESSING FEATURE AND METHOD FOR MAKING THE CONNECTOR" and assigned to the same assignee as this patent application. This patent application is a contemporaneously filed application, invented by Jerry Wu, entitled "CABLE END CONNECTOR ASSEMBLY WITH IMPROVED SHIELDING MEANS" and assigned to the same assignee as this patent application.

BACKGROUND OF THE INVENTION

1. Field of the Invention

The present invention relates to a cable end connector assembly, and particularly to a high speed cable end connector assembly for use in InfiniBand™ application.

2. Description of Related Art

As demands for high bandwidth and low latency in computer technology increase, the emerging InfiniBand™ architecture is being developed by the information industry. InfiniBand™ architecture de-couples an I/O subsystem from memory by utilizing point-to-point connections rather than a shared bus. lnfiniBand™ products are ideally suited for clustering, I/O extensions, and native attachment in many network applications and can be used in high-performance server applications, providing a cost-effective transition from existing technologies.

To achieve the technology performance of the InfiniBand™ architecture, an InfiniBand™ product must provide a sufficiently large number of signal contacts with a fairly fine pitch for signal transmission. Thus, the InfiniBand™ product has a relatively complex structure. An InfiniBand™ cable end connector assembly comprises an electrical connector having a plurality of signal and grounding terminals therein, a cable having a plurality of lines, a plurality of shielding plates, a spacer to which front ends of the lines and the shielding plates are assembled, and an internal printed circuit board interconnecting the connector and the cable. Each line comprises a pair of signal conductors electrically connecting with the signal terminals of the electrical connector via the printed circuit board, and a grounding conductor being soldered with corresponding shielding plate and electrically connecting with corresponding grounding terminal via the printed circuit board. Inevitably, the existence of the internal printed circuit board and the spacer complexes the structure of the InfiniBand™ cable end connector assembly and increases the manufacturing cost. This is no doubt out of the current trend.

Hence, a cable end connector assembly for InfiniBand™ application with a relatively simple structure and lower manufacturing cost is required to overcome the disadvantages of the related art.

SUMMARY OF THE INVENTION

A first object, therefore, of the present invention is to provide a cable end connector assembly with a relatively simple structure and a lower cost.

A second object of the present invention is to provide a cable end connector assembly having an improved terminal structure which can readily and reliably terminate conductors of a cable.

In order to achieve the objects set forth, a cable end connector assembly comprises a base, a cover fixed on the base, and a cable connector module mounted between the cover and the base. The cable connector module comprises a cable, a plurality of shielding plates, and a plurality of signal terminals. The cable comprises a plurality of lines each comprising a signal pair and a grounding conductor. The signal pair comprises a first signal conductor and a second signal conductor. The shielding plates are respectively soldered with the grounding conductors. Each of the signal pairs of the cable is located between two neighboring shielding plates. The first and second signal conductors of said leach of the signal pairs are located at an upper position and a lower position, respectively. Each signal terminal comprises a mating portion for electrically engaging with a complementary connector, and a tail portion being soldered with corresponding signal conductor. The tail portion comprises a plurality of grasping portions extending vertically therefrom and grasping the signal conductor tightly for transmitting signals reliably.

Other objects, advantages and novel features of the invention will become more apparent from the following detailed description when taken in conjunction with the accompanying drawings.

DETAILED DESCRIPTION OF THE INVENTION

Figure 1:
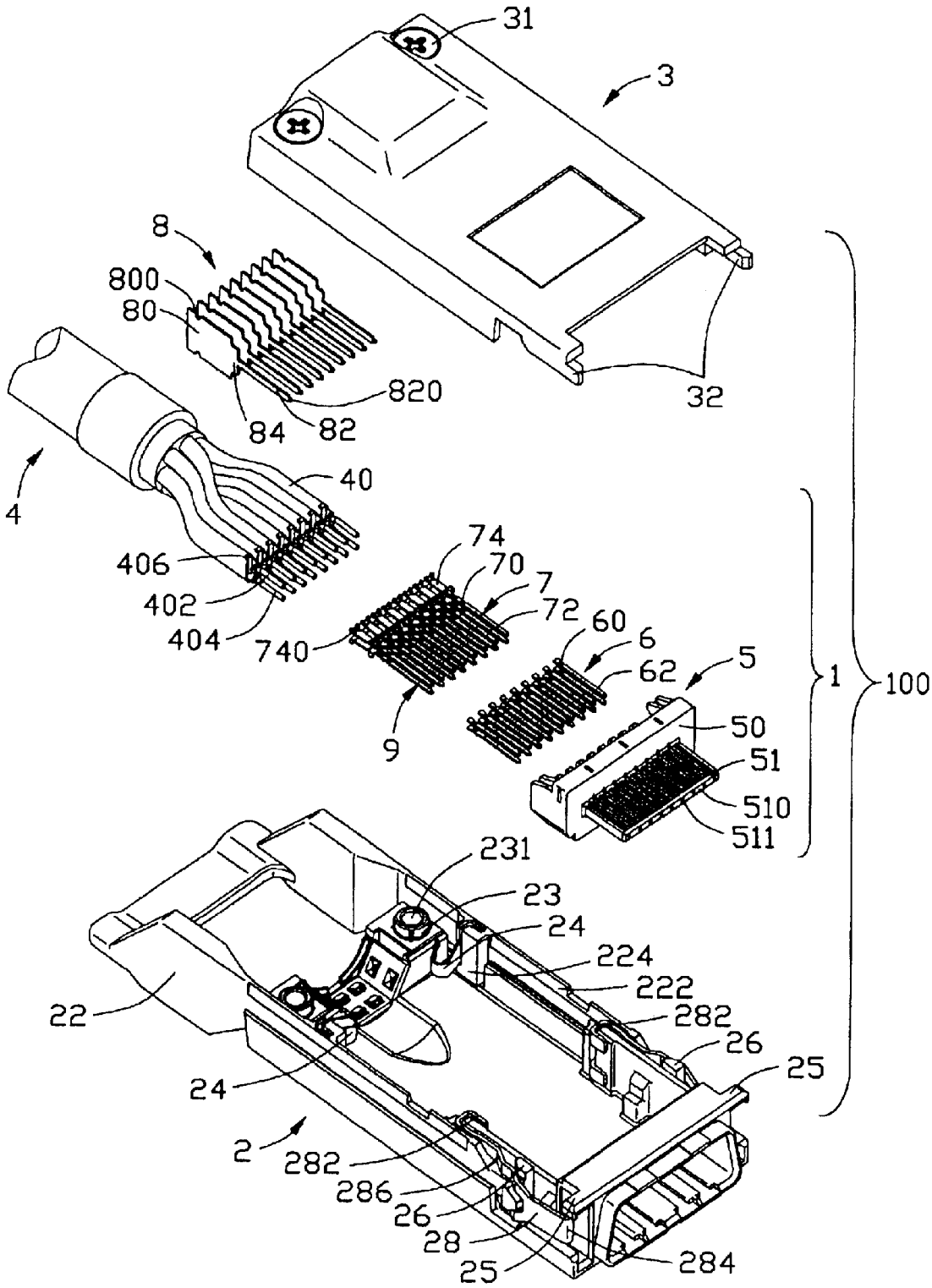
FIG. 1 is an exploded, perspective view of a cable end connector assembly in accordance with the present invention.
Figure 2:
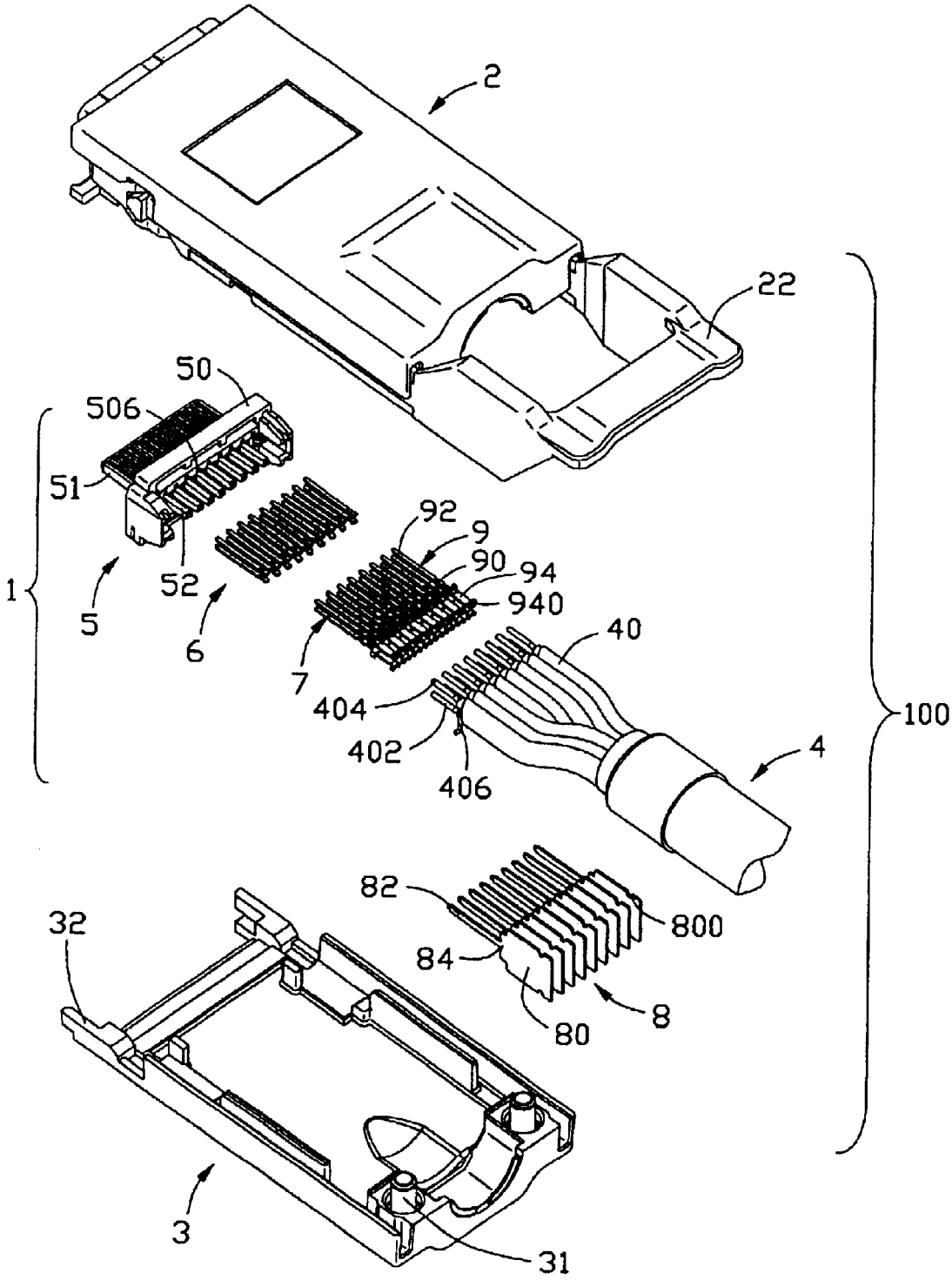
FIG. 2 is a view similar to FIG. 1, but taken from rear and bottom aspects.
Figure 5:
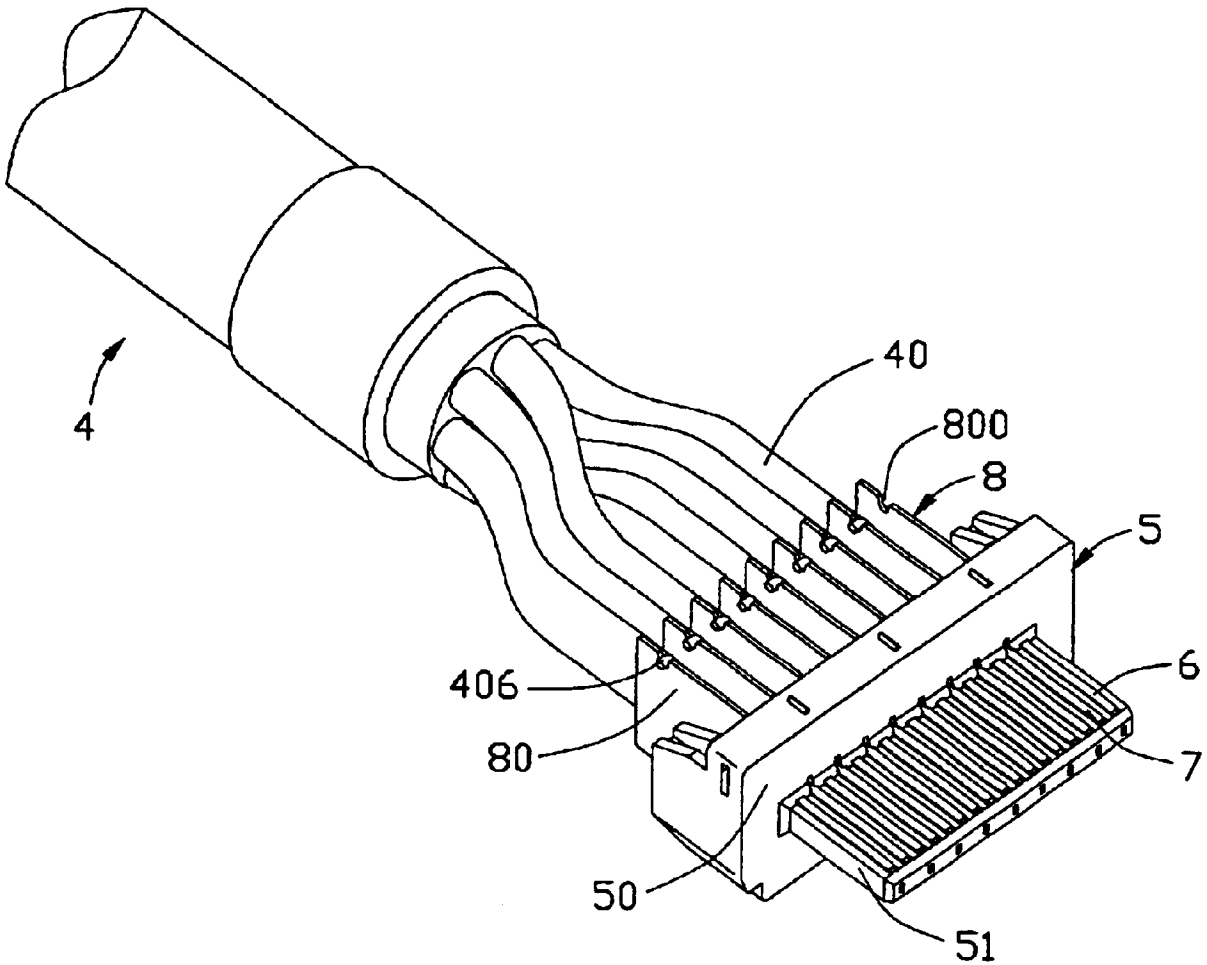
FIG. 5 is an assembled, perspective view of the cable connector module of FIG. 1.
Figure 6:
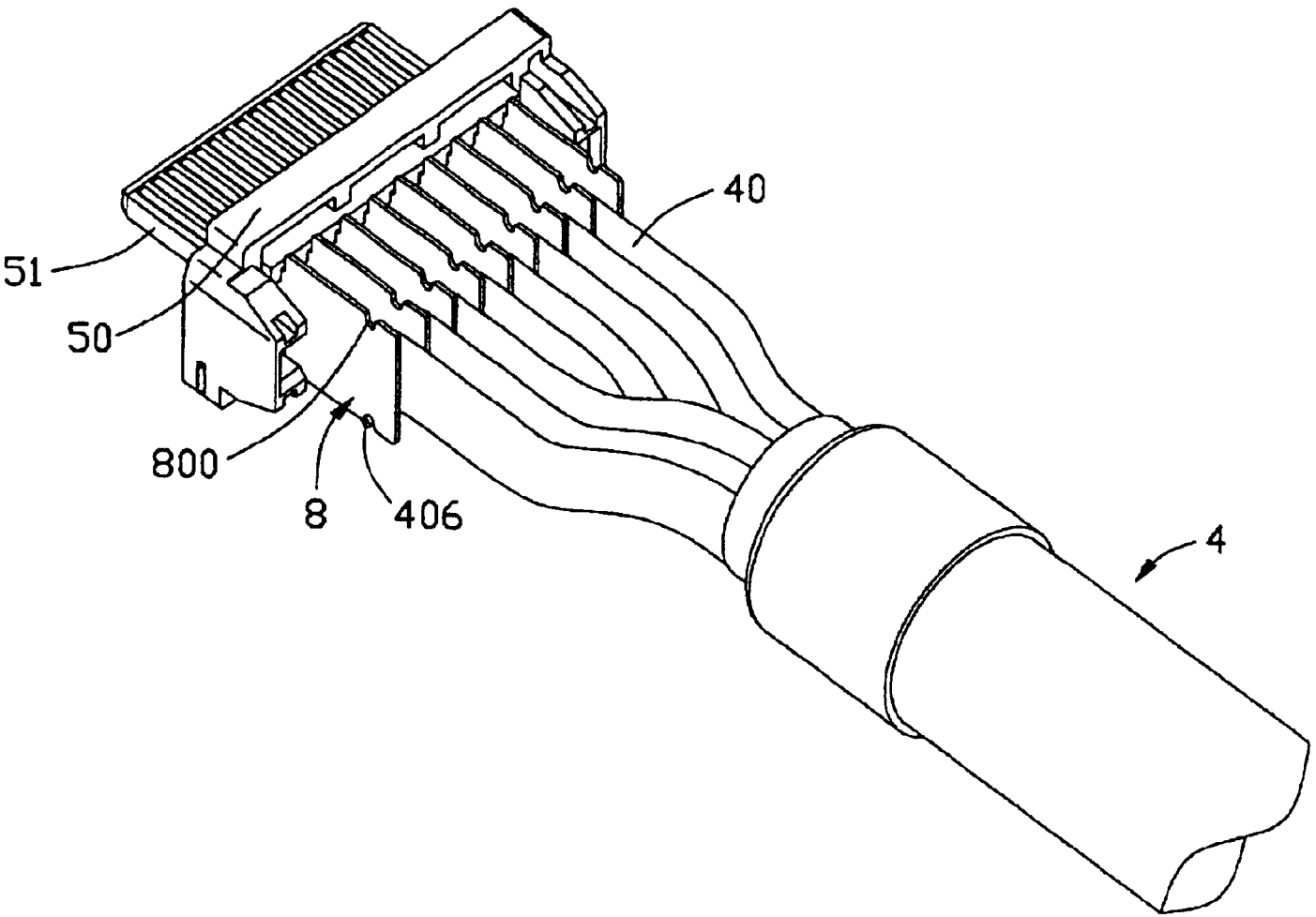
FIG. 6 is a view similar to FIG. 5, but taken from rear and bottom aspects.
Figure 7:
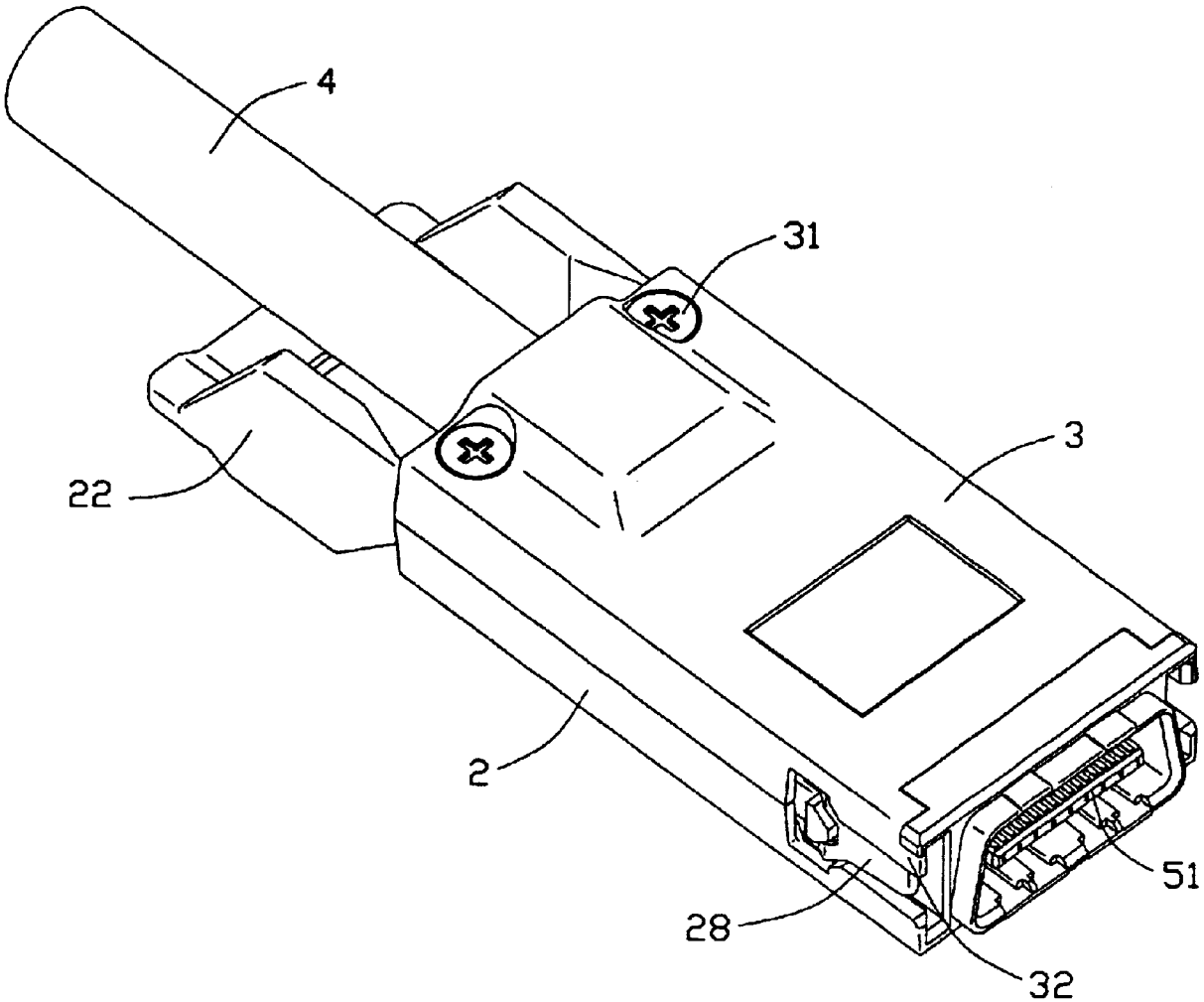
FIG. 7 is an assembled, perspective view of the cable end connector assembly of FIG. 1.
Figure 8:
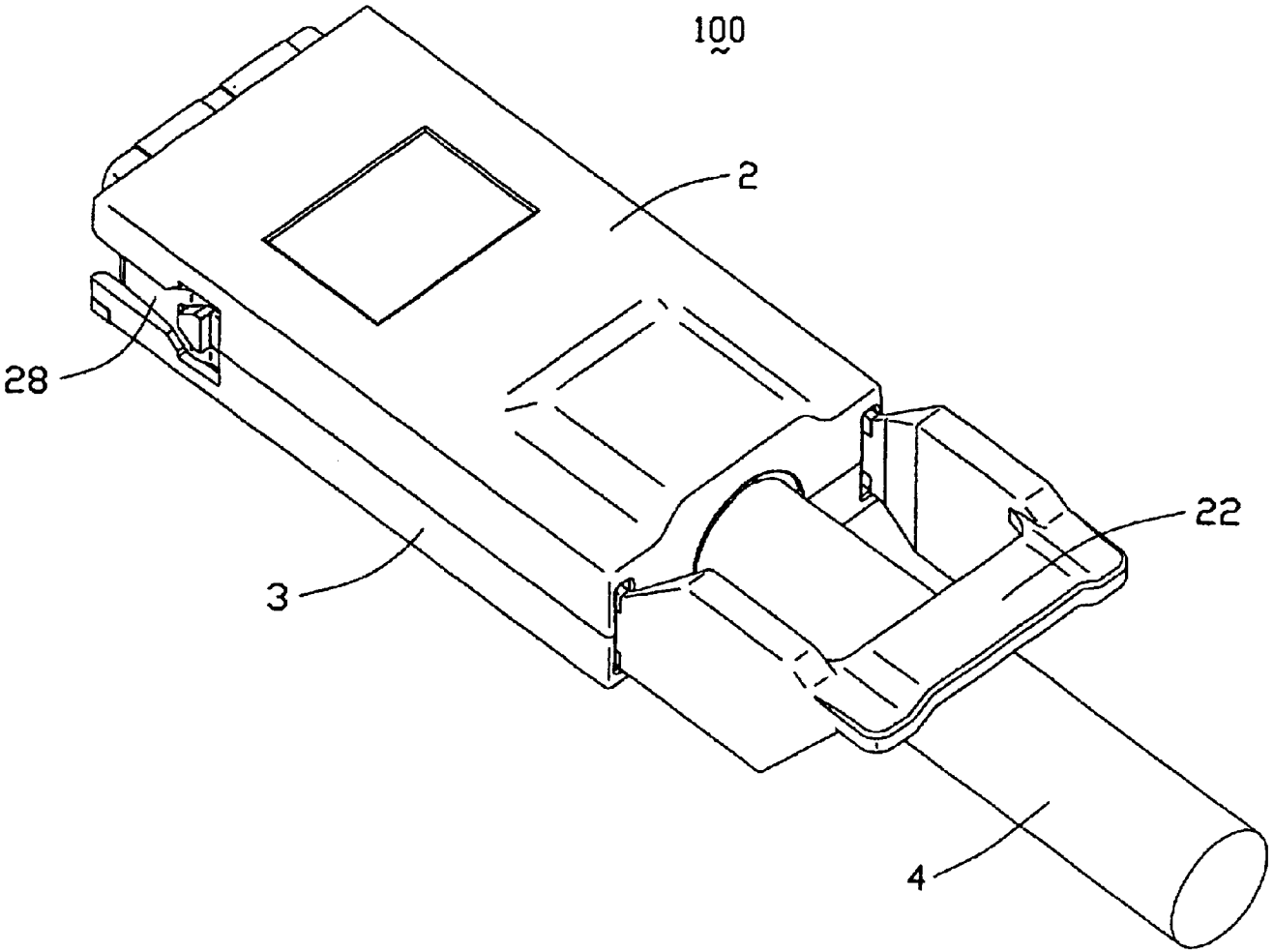
FIG. 8 is a view similar to FIG. 7, but taken from rear and bottom aspects.
Figure 9:
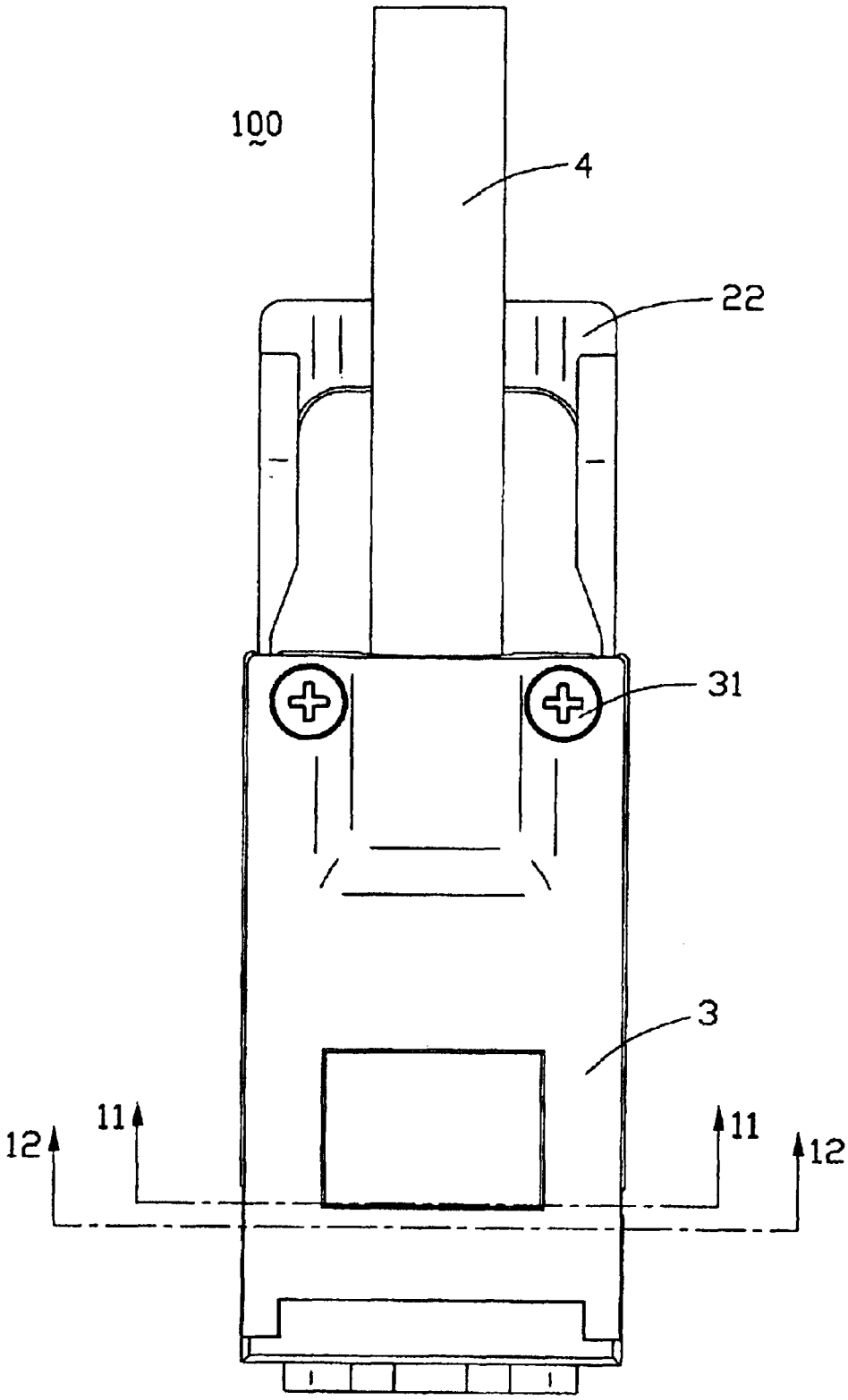
FIG. 9 is a top plan view of the cable end connector assembly of FIG. 7.
Figure 10:
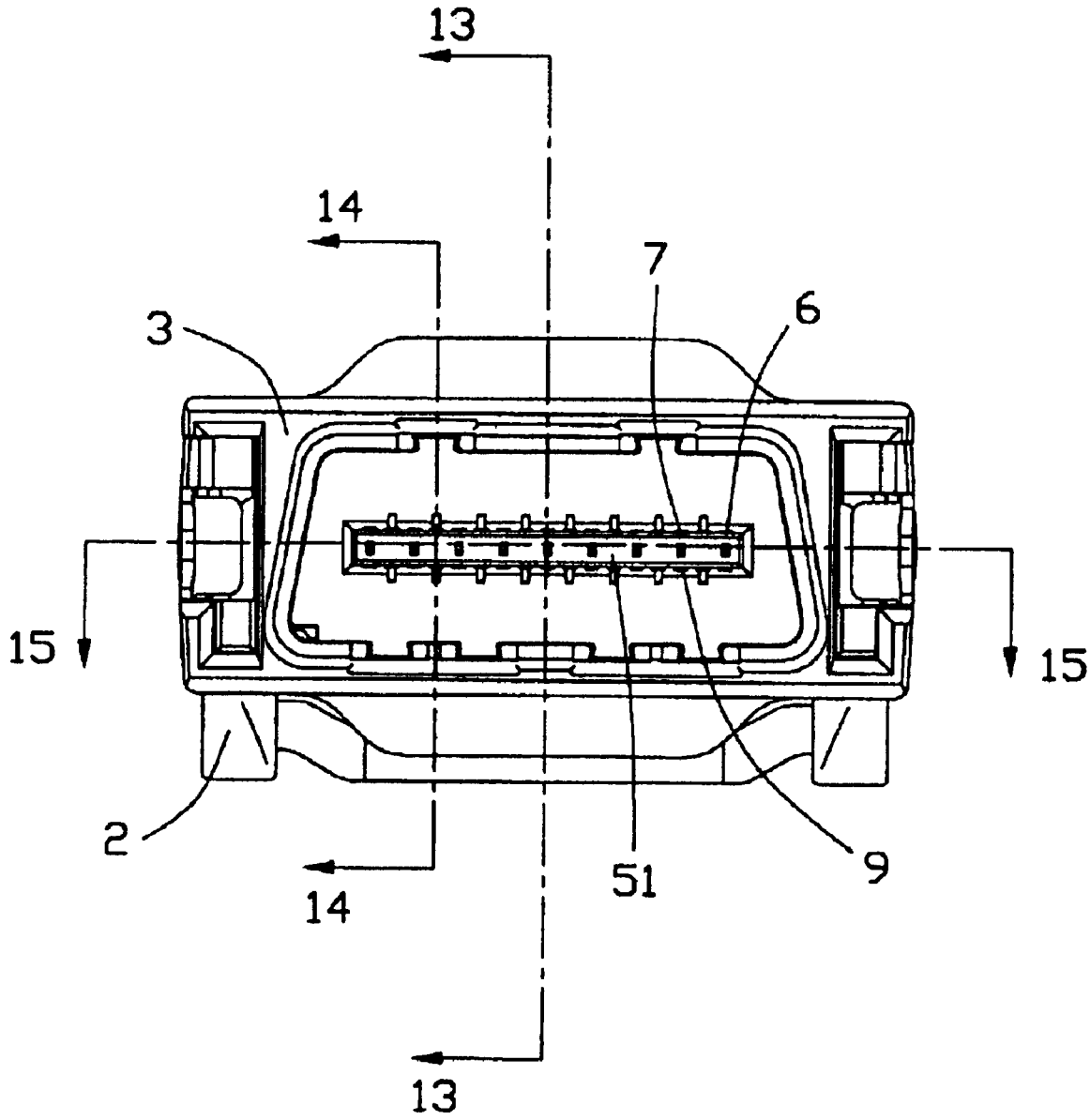
FIG. 10 is an elevational view of the cable end connector assembly of FIG. 7.
Figure 11:
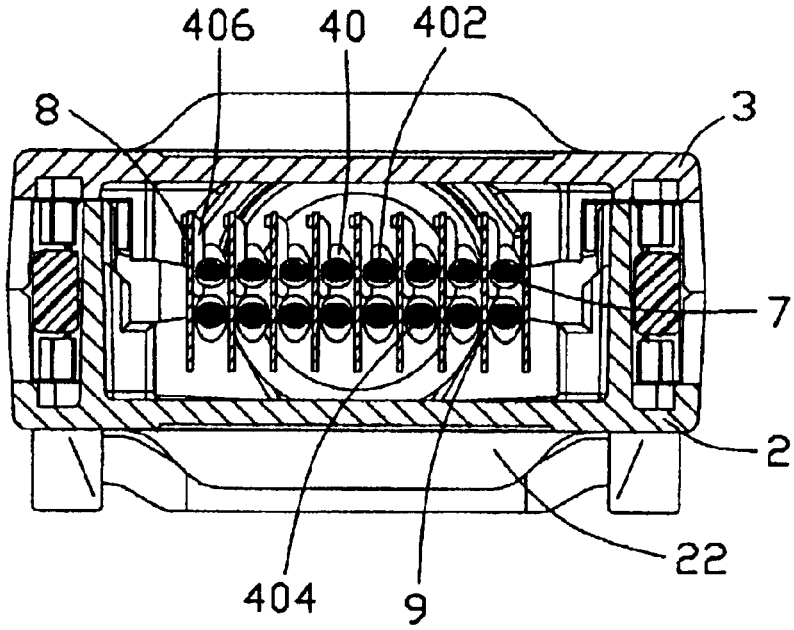
FIG. 11 is a cross-sectional view taken along line 11—11 of FIG. 9.
Figure 12:
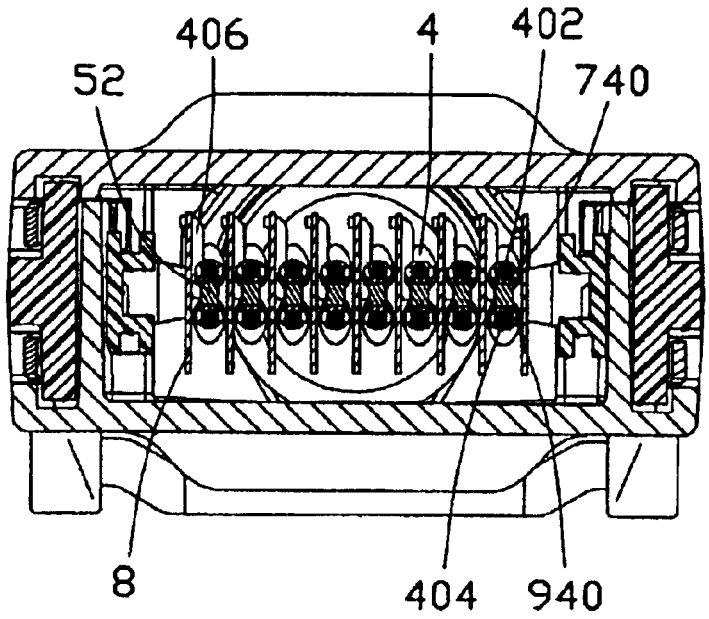
FIG. 12 is a cross-sectional view taken along line 12—12 of FIG. 9.

Referring to FIGS. 1 and 2, and in conjunction with FIGS. 5 and 6, a cable end connector assembly 100 for use in an InfiniBand™ application in accordance with the present invention comprises a cover 3, a base 2, and a cable connector module 1 located between the cover 3 and the base 2.

Also referring to FIGS. 1 and 2, the cable connector module 1 includes a cable 4 accommodating eight lines 40 therein, a housing 5, a plurality of signal and grounding terminals, and a plurality of shielding plates 8.

Each line 40 has an elliptical profile and comprises a differential pair of signal conductors 402, 404 and a grounding conductor 406. The signal conductors 402, 404 of the signal pair of each line 40 are so arranged that they are vertically aligned with each other. The grounding conductor 406 of each line 40 is located between and on topside of every two neighboring signal pairs.

Figure 13:
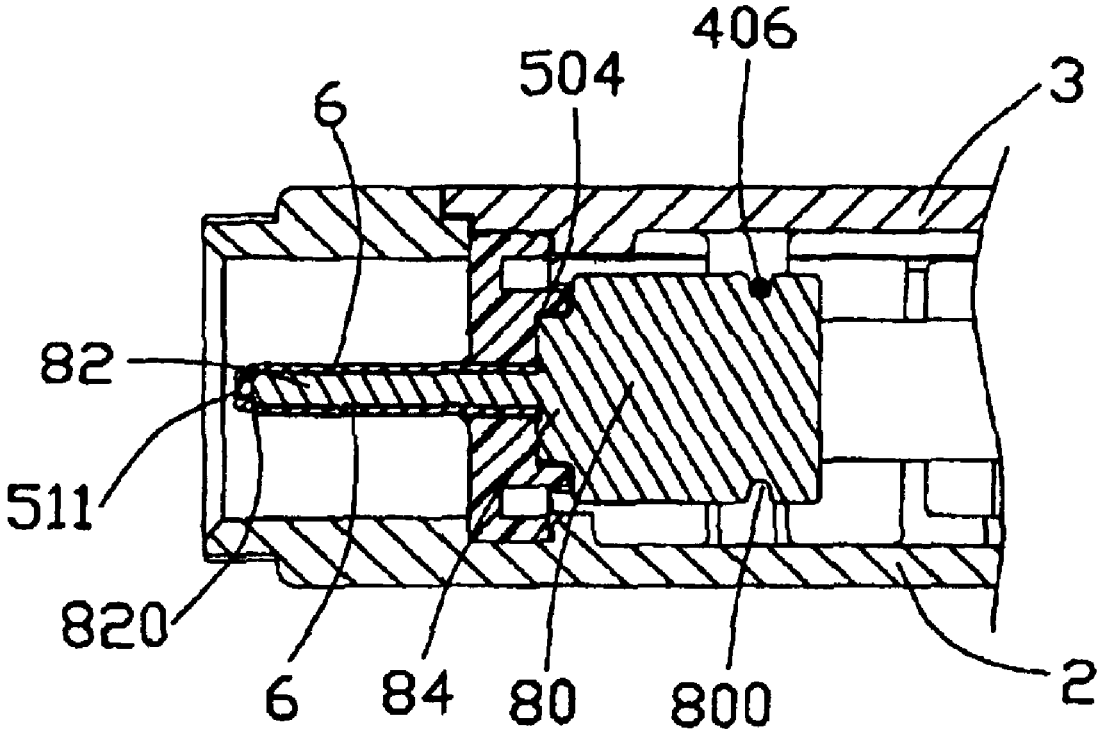
FIG. 13 is a partly cross-sectional view taken along line 13—13 of FIG. 10.
Figure 14:
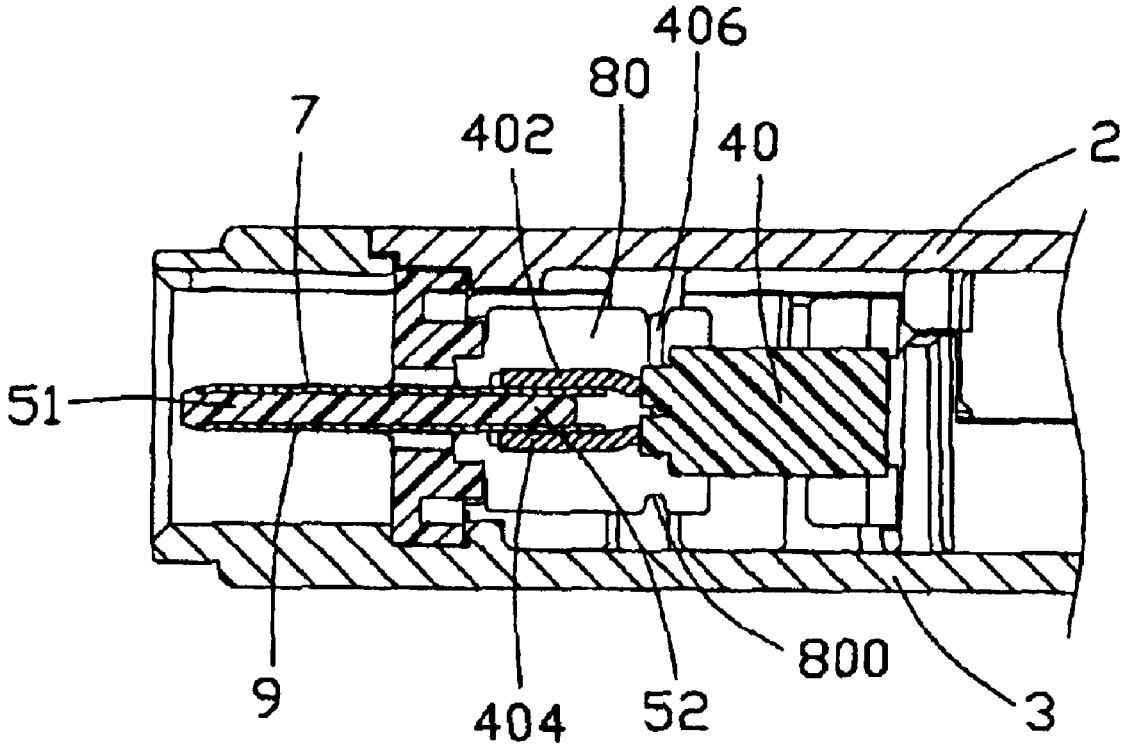
FIG. 14 is a partly cross-sectional view taken along line 14—14 of FIG. 10.
Figure 15:
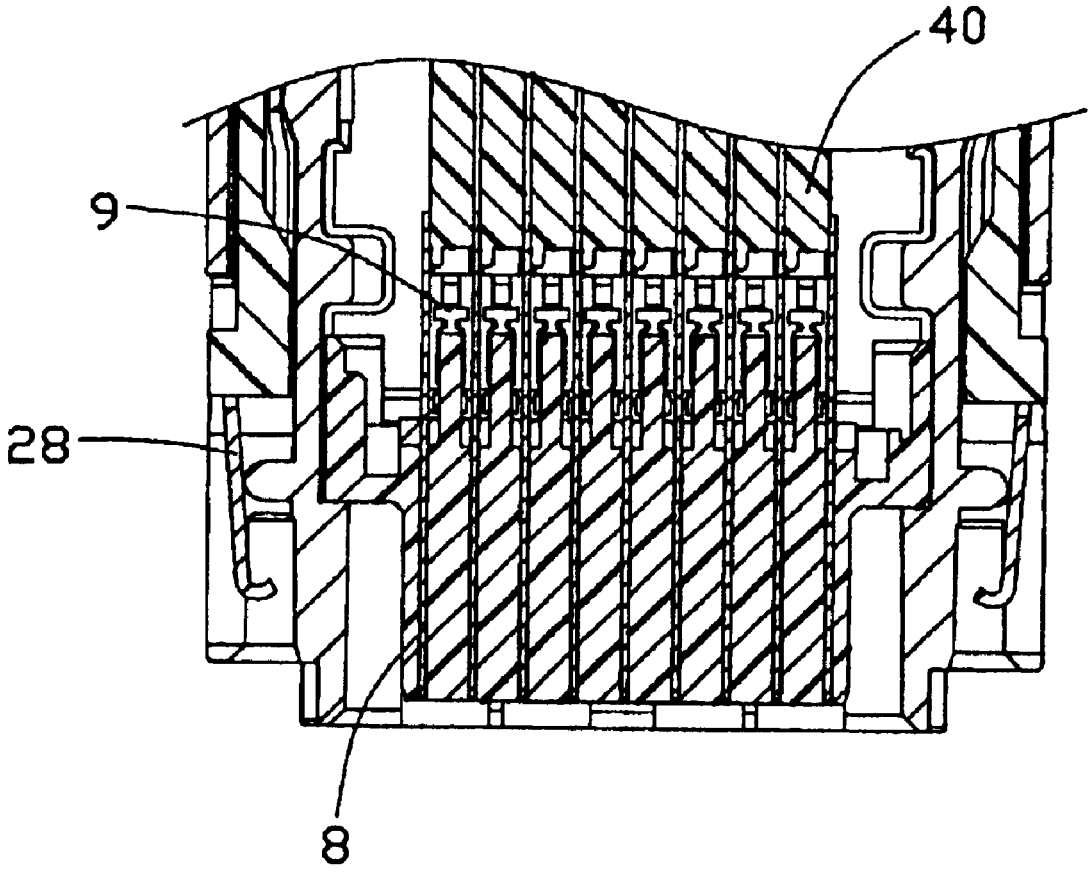
FIG. 15 is a partly cross-sectional view taken along line 15—15 of FIG. 10.

The housing 5 comprises a body 50 and a tongue 51 projecting forwardly from the body 50. The tongue 51 defines a front surface 510 parallel to a rear surface of the body 50. Nine passages 512 are defined through the tongue 51. Eight passageways 514 are defined between every two adjacent passages 512 and at opposite upper and lower surfaces of the tongue 51. Nine holes 511 are defined in the tongue 51 for providing each passage 512 an opening to the front surface 510 of the tongue 51. Eight dividing posts 52 extend rearwardly and integrally from a rear of the tongue 51 and extend beyond the rear surface of the body 50. Nine cutouts 504 (referring to FIG. 13) are defined through the body 50 and communicate with the passages 512, respectively. Each cutout 504 has a bigger width at one end and a smaller width at middle portion. A pair of recesses 506 is defined through the body 50 located above and below corresponding dividing post 52 and communicating with corresponding pair of passageways 514.

The terminals comprises eighteen grounding terminals 6 arranged in two rows, nine shielding plates 8, eight first signal terminals 7, and eight second signal terminals 9 parallel to the first signal terminals 7. Each grounding terminal 6 comprises a retention portion 60 and a flat contact portion 62 for engaging with a complementary connector. Each shielding plate 8 comprises a contact portion 82 for being received in the passages 512 of the tongue 51, a flat body portion 80, and a shoulder portion 84 connecting the contact portion 82 and the body portion 80. The body portion 80 has a large surface area thereby providing better grounding protection for signal transmission and defines a pair of opposite notches 800 in upper and lower edges thereof.

Each first and second signal terminal 7, 9 comprises a retention portion. 70, 90 for retaining the signal terminal 7, 9 in the housing 5, a contact portion 72, 92 extending forwardly from the retention portion 70, 90 for engaging with the complementary connector, and a tail portion 74, 94 extending rearwardly from the retention portion 70, 90. The tail portion 74 of the first signal terminal 7 comprises a flat main portion and a pair of thin portions extending from opposite ends of the main portion. Each thin portion forms a pair of grasping portions 740 bending upwardly from opposite sides thereof. The tail portion 94 of the second signal terminal 9 has the same structure as that of the tail portion 74 of the first signal terminal 7 except that the pair of grasping portions 940 bending downwardly from opposite sides of each thin portion, respectively.

Furthermore, in assembly, the contact portions 72, 62 of the first signal terminals 7 and the upper row of the grounding terminals 6 have flat shape and are arranged in a plane which is parallel to the upper surface of the tongue 51. The contact portions 92, 62 of the second signal terminals 9 and the lower row of the grounding terminals 6 have flat shape and are arranged in a plane which is parallel to the lower surface of the tongue 51. While the contact portions 82 of the shielding plates 8 are arranged in a plane which is perpendicular to the upper and lower surfaces of the tongue 51 and parallel to the insertion direction thereof.

Figure 3:
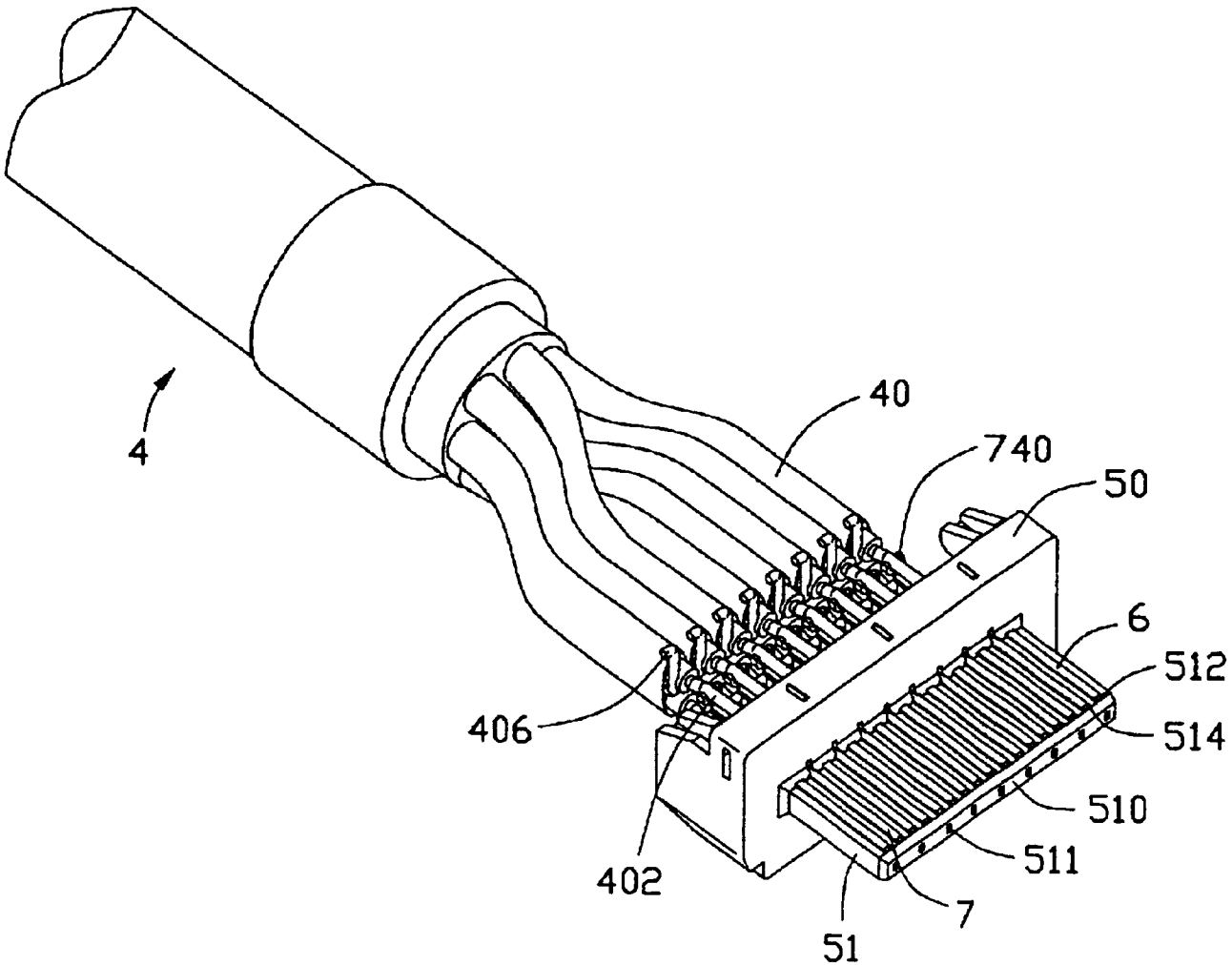
FIG. 3 is an assembled, perspective view of a cable connector module of the cable end connector assembly of FIG. 1, except for shielding plates.
Figure 4:
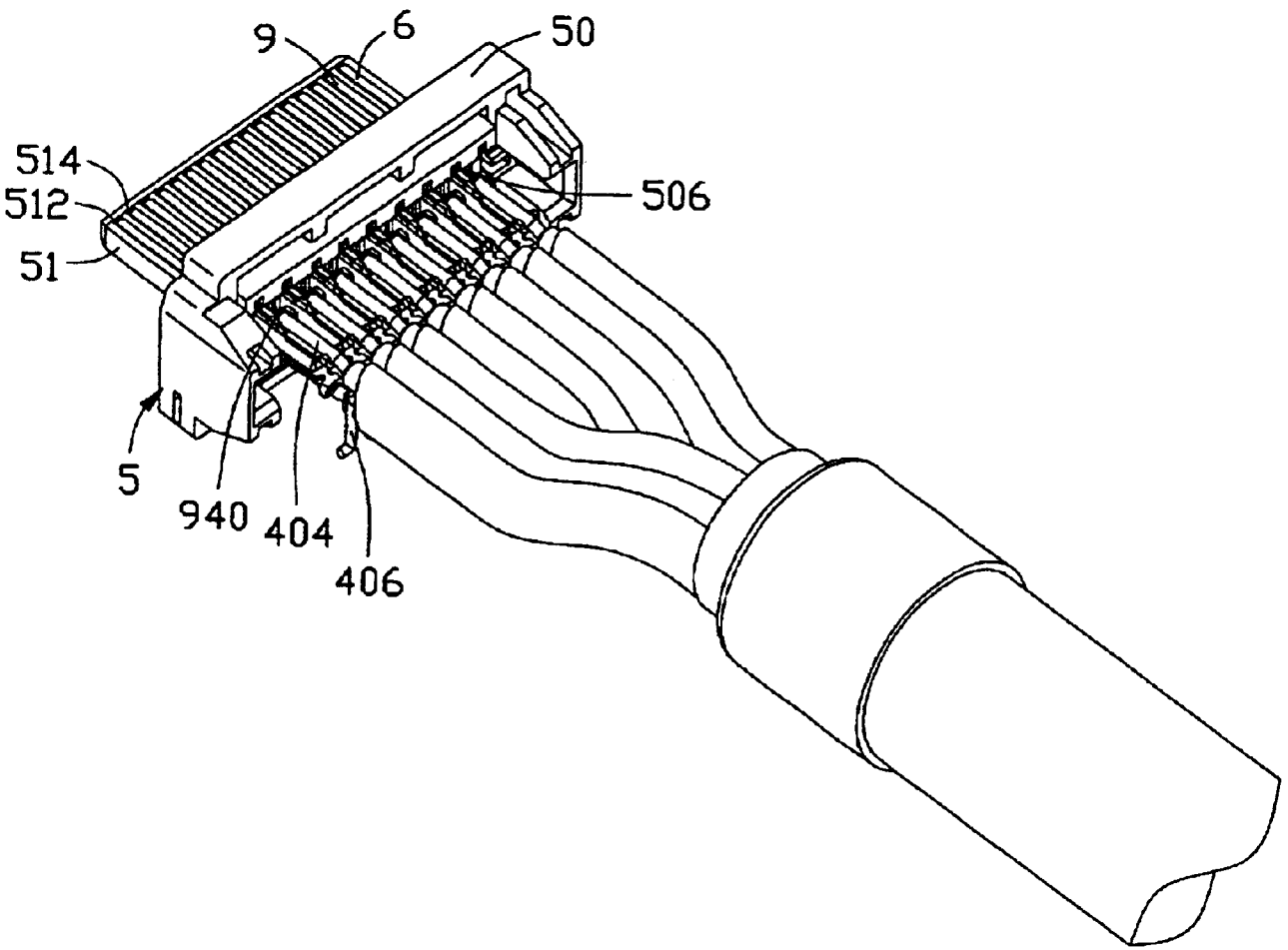
FIG. 4 is a view similar to FIG. 3, but taken from rear and bottom aspects.

Referring to FIGS. 3 and 4, and in conjunction with FIGS. 11 to 16, the first and second signal terminals 7, 9 and the grounding terminals 6 are respectively inserted into the housing 5. Each pair of the first and second signal terminals 7, 9 protrude through corresponding pair of recesses 506, and further the contact portions 72, 92 thereof are respectively received in the passageways 514 communicating with the recesses 506. The pair of retention portions 70, 90 of the first and second signal terminals 7, 9 respectively engage with opposite inner surfaces of the recesses 506 for retaining the terminals 7, 9 in the housing 5. The pair of tail portions 74, 94 are located on opposite upper and lower surfaces of the dividing post 52. Thus, when the tail portions 74, 94 are soldered with the signal conductors 402, 404, the dividing posts 52 provide enough supporting force to the tail portions 74, 94 for preventing unnecessary deformation. Then, the two rows of the grounding terminals 6 protrude through the cutouts 504, and further the contact portions 62 thereof are respectively received in the passages 512 defined through the tongue 51. The retention portion 60 of each grounding terminal 6 engages with opposite inner surfaces of corresponding through hole for retaining the grounding terminal 6 in the housing 5. The signal conductors 402, 404 of the differential pair of each line 40 are respectively soldered with the flat main portions of the tail portions 74, 94 of the first and second signal terminals 7, 9 for transmitting signals between the cable end connector assembly 100 and the complementary connector. The two pairs of grasping portions 740, 940 of each signal terminal 7, 9 hold a front portion and a rear portion of corresponding signal conductor 402, 404 tightly assuring the reliable termination between the signal conductors 402, 404 and the signal terminals 7, 9.

Now referring to FIGS. 5 and 6, and in conjunction with FIGS. 11 to 16, the nine shielding plates 8 are assembled to the housing 5. The contact portion 82 of each shielding plate 8 protrudes through corresponding cutout 504_and is received in corresponding passage 512 until the tip 820 of the contact portion 82 is received in corresponding hole 511. The shoulder portion 84 is received in the cutout 504 for retaining the shielding plate 8 to the housing 5. The body portion 80 having a large surface area separates every two neighboring lines 40. Accordingly, cross talk between two neighboring lines 40 can be effectively suppressed by the body portions 80 of the shielding plates 8. Subsequently, the grounding conductor 406 of each line 40 is received in one notch 800 of the body portion 80 of corresponding shielding plate 8 and soldered therewith. Therefore, the assembly of the cable connector module I is finished, and the signal conductors 402, 404 of the cable 4 electrically connect with the signal terminals 7, 9 for signal transmission, and the grounding conductors 406 of the cable 4 electrically connect with the shielding plates 8 for providing grounding protection to differential pairs of the signal conductors 402, 404. The grounding terminals 6 provide grounding protection to the first and second grounding terminals 7, 9.

Referring back to FIGS. 1 and 2, both the cover 3 and the base 2 are formed by die casting of metal such as aluminum alloy. The cover 3 is provided with a pair of screws 31 for screwing into screw holes 231 defined in studs 23 formed in the base 2 after the cable connector module 1 is put in the base 2 to thereby assemble the cover 3, the cable connector module 1, and the base 2 together. To mount the cover 3 to the base 2, firstly protrusions 32 formed on a front end of the cover 3 are positioned below side flanges 25 formed on a front end of the base 2, respectively. Then a rear end of the cover 3 on which the screws 31 are located is pivoted downwardly about the flanges 25 toward the base 2 until the rear end of the cover 3 is in contact with a rear end of the base 2. The cable end connector assembly 100 is further provided with a pull tab 22 movably mounted between the cover 3 and the base 2 for releasing a latch between the cable end connector assembly 100 and the complementary connector.

The pull tab 22 has two arms 222 extending forwardly, each arm 222 forming a mounting block 224 at an inner side of a rear portion thereof and a driving block 26 at the inner side of a front end thereof. A pair of latches 28 is mounted on a front portion of lateral walls of the base 2. Each latch 28 has a hooked front end 284 for latching with the complementary connector when the cable end connector assembly 100 in accordance with the present invention mates with the complementary connector, a rear end 282 fixedly secured to the base 2, and a cam portion 286 formed between the hooked front end 284 and the rear end 282. The cam portion 286 has an inner face abutting against the driving block 26 of a corresponding arm 222 of the pull tab 22. The cam portion 286 has an inwardly, rearwardly stepped configuration, whereby when the driving block 26 moves rearwardly as the pull tab 22 is pulled rearwardly, the driving block 26 causes the cam portion 286 and thus the hooked front end 284 to move laterally outwardly, thereby to release the latch between the cable end connector assembly 100 and the complementary connector. A pair of leaf springs 24 is provided with the cable end connector assembly 100 wherein each spring 24 has a front end fixed in the mounting block 224 of a corresponding arm 222 of the pull tab 22, and a rear end fixed to the base 2. When the pull tab 22 is pulled rearwardly, the springs 24 are compressed. When the pulling force is released, the springs 24 return to their original configurations, thereby motivating the pull tab 22 to return to its original position prior to being pulled. Thus, the latches 28 return to their original position as shown in FIG. 1.

Referring to FIGS. 7–16, now the assembly of the cable end connector assembly 100 in accordance with the present invention is finished. The signal conductors 402, 404 of the lines 40 electrically connect with the signal terminals 7, 9 directly other than via an inner printed circuit board, thereby the manufacturing cost is decreased. The grasping portions 740, 940 formed on the signal terminals 7, 9 tihgtly hold the signal conductors 402, 404 thereby assure reliable termination between the cable 4 and the terminals. Every two neighboring lines 40 are separated by corresponding shielding plate 8, thereby sufficiently suppressed the cross talk therebetween. Furthermore, the shielding plate 8 has a relatively simple struture and terminates with corresponding grounding conductor 406 reliably.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly, comprising;

a base;

a cover fixed on the bass; and a cable connector module mounted be en the cover and the base, comprising:

a cable extending in a front-to-back direction and comprising a plurality of lines each comprising a signal pair and a grounding conductor, the signal pair comprising a first signal conductor and a second signal conductor;

a plurality of shielding plates, each shielding plate defining a notch, the grounding conductors respectively retained in the notches of the shielding plates in a lateral direction perpendicular to said front-to-back direction, each of the signal pairs being located between two neighboring shielding plates, wherein the first and second signal conductors of said each of the signal pairs are located at an upper position and a lower position, respectively; and a plurality of signal terminals each comprising a mating portion adapted for electrically engaging with a complementary connector, and a tail portion being soldered with corresponding signal conductor, wherein the tail portion comprising a plurality of rasping portions extending vertically therefrom and grasping the signal conductor tightly for transmitting signals reliably.

2. The cable end connector assembly as claimed in claim 1, further comprising a plurality of grounding terminals adapted for providing grounding protection to the cable end connector assembly and the complementary connector, the signal terminals and locate between every two neighboring grounding terminals.

3. The cable end connector assembly as claimed in claim 2, wherein each shielding plate comprises a body portion and a contact portion extending forwardly from the body portion, the body portion has a large surface area adapted for providing better grounding effect to the neighboring lines of the cable.

4. The cable end connector assembly as claimed in claim 3, wherein the shielding plate further comprises a shoulder portion connecting the body portion and the tail portion.

5. The cable end connector assembly as claimed in claim 4, wherein the body portion of each shielding plate defines a pair of notches in an upper and a lower edges thereof, the corresponding grounding conductor is respectively received in one notch and soldered therewith.

6. The cable end connector assembly as claimed in claim 3, further comprising a housing having a tongue projecting forwardly and a plurality of dividing posts extending rearwardly.

7. The cable end connector assembly as claimed in claim 6, wherein the signal terminals are arranged in two rows and at an upper position and a lower position, respectively, the signal terminals are received in passageways defined in an upper and a lower surface of the tongue of the housing, the tail portions of the signal terminal are located on opposite surfaces of corresponding dividing post of the housing in pairs for preventing firm being deformed.

8. The cable end connector assembly as claimed in claim 1, wherein said tail portion of each signal terminal comprises a body portion and a pair of grasping portions formed on opposite ends of the body portion.

9. The cable end connector assembly as claimed in claim 8, wherein said signal conductor of each line is soldered on the body portion of the tail portion of corresponding signal terminal and the grasping portions hold the signal conductor tightly.

10. The cable end connector assembly as claimed in claim 6, wherein a plurality of passages is defined through the tongue, said each passageway is between every two neighboring passages, the grounding terminals are received in the passages, respectively.

11. The cable end connector assembly as claimed in claim 6, where a plurality of cutouts are defined through the body and communicate with the passages, respectively, the contact portions of the shielding plates are received in the passages and the shoulder portions are received in the cutouts, respectively, each contact portion engaging with corresponding pair of grounding terminals received in the same passage.

12. The cable end connector assembly as claimed in claim 1, further comprising a pair of metal latches located at a front end of lateral walls of the base adapted for latching with the complementary connector, and a pull tab received in the base and having a pair of driving blocks in engaging with the latches, respectively, said driving blocks driving said latches to move in a direction for releasing the latch between the cable end connector assembly and the complementary connector when the pull tab is pulled rearwardly.

13. The cable end connector assembly as claimed in claim 12, further comprising at least one resilient member which is deformed when the pull tab is pulled.

14. The cable end connector assembly as claimed in claim 13, wherein the base and the cover are made of metal.

15. A cable end connector assembly, comprising:

a metal shell;

a pull tab slideably mounted in the shell;

a latch mounted in the shell and drivably connected with the pull tab, the latch being adapted for latching with a complementary connector;

an insulative housing received in the metal shell;

a plurality of signal and grounding terminals alternately disposed in the insulative housing, each signal terminal comprising a mating portion adapted for electrically connecting with the complementary connector and a tail portion having a plurality of grasping portions vertically bending therefrom;

a cable comprising a plurality of lines each having a pair of upper and lower signal conductors and a grounding conductor, the signal conductors respectively soldered with the signal terminals and being grasped by the grasping portions of the signal terminals; and a plurality of shielding plates secured to the insulative housing, each shielding plate electrically connecting with the grounding conductor, and the signal conductor being located between two neighboring shielding plates.

16. A cable connector assembly comprising:

a cover assembly;

a connector module retained in said cover assembly and comprising:

a housing defining a forwardly extending tongue thereof;

a plurality of signal and grounding terminals alternately disposed in the housing and exposed to an exterior on said extending tongue;

a plurality of shielding plates disposed in the housing, each of said shielding plates contacting the corresponding grounding terminals and separating the corresponding two neighboring signal terminals; and a cable comprising a plurality of lines each including a pair of signal conductors and a grounding conductor; wherein the signal conductors are mechanically and electrically connected to the corresponding signal terminals, respectively, and the grounding conductor is mechanically and electrically connected to the shielding plate.

17. The cable connector assembly as claimed in claim 16, wherein said signal conductor is retained in a notch of the corresponding signal terminal along a front-to-back direction, while the grounding conductor is retained in a notch of the corresponding shielding plate along a lateral direction perpendicular to said front-to-back direction.

18. The cable connector assembly as claimed in claim 16, wherein said shielding plate extends into the tongue and contacts a contact portion of the corresponding grounding terminal in a vertical direction.

19. The cable connector assembly as claimed in claim 18, wherein the contact portion of said grounding terminal extends in a horizontal plane while the corresponding shielding plate which contacts the contact portion of the grounding terminal, extends in a vertical plane perpendicular to said horizontal plane.

* * * * *